United States Patent [19]

Livsey

[11] Patent Number: 5,024,755

[45] Date of Patent: Jun. 18, 1991

[54] CONE WEAR DETECTION

[75] Inventor: James D. Livsey, Rochester, Mass.

[73] Assignee: Bird Escher Wyss, Mansfield, Mass.

[21] Appl. No.: 440,891

[22] Filed: Nov. 22, 1989

[51] Int. Cl.[5] ..... B04C 5/08

[52] U.S. Cl. ..... 209/211; 138/36; 210/512.1

[58] Field of Search ..... 209/211, 1, 546; 210/512, 1; 138/36; 73/40.5 R, 49.1; 116/209

[56] References Cited

U.S. PATENT DOCUMENTS

| | | | |
|---|---|---|---|
| 1,426,956 | 8/1922 | Case | 138/36 |
| 1,938,475 | 4/1932 | Alexander | 138/36 |
| 1,975,832 | 9/1931 | DeFlorez | 138/36 |
| 1,977,177 | 3/1931 | DeFlorez | 138/35 |
| 4,211,643 | 7/1980 | Frykhult et al. | 209/211 |
| 4,278,534 | 7/1981 | Jakobson | 209/211 |
| 4,358,369 | 11/1982 | Matula et al. | 209/211 |
| 4,617,822 | 10/1986 | Davis | 138/36 X |

FOREIGN PATENT DOCUMENTS

| | | | |
|---|---|---|---|
| 145324 | 6/1985 | European Pat. Off. | 209/211 |
| 1152950 | 4/1961 | Fed. Rep. of Germany | 138/36 |
| 0250535 | 11/1986 | Japan | 116/209 |
| 827182 | 5/1981 | U.S.S.R. | 209/211 |

*Primary Examiner*—Donald T. Hajec

*Attorney, Agent, or Firm*—Fish & Richardson

[57] ABSTRACT

Hydrocyclone for dividing a liquid-solid suspension into an accept portion and a reject portion having a separation chamber including a conical section, a tangential feed inlet to the separation chamber, an axial accept outlet from the separation chamber, and a reject outlet. The concial portion of the separation chamber includes areas of reduced wall thickness for facilitating the detection and repair of a leakage in the wall. Sealing devices for arresting such a leakage are provided.

6 Claims, 1 Drawing Sheet

SECTION A-A

CONE WEAR DETECTION

BACKGROUND OF THE INVENTION

This invention relates to a hydrocyclone for dividing a liquid-solid suspension into an accept and a reject portion.

Hydrocyclones are used in the purification of fluid-particle suspensions, with particular application to liquid-fiber suspensions such as in the manufacture of pulp and paper products. The liquid-fiber suspension, including contaminants, enters the hydrocyclone under pressure through a tangential feed inlet. A rotational motion is imparted to the liquid-fiber-contaminants suspension as it enters the separation chamber, which consists, in part, of a conical portion. The rotational motion of the suspension causes a separation of the contaminants from the acceptable fiber. The contaminant portion of the suspension, which may contain dirt and metal particles, fiber bundles and other heavy debris, separates out to the wall of the separation chamber due to centrifugal action and is carried along the wall of the separation chamber to the conical portion of the chamber. As the conical portion converges, the centrifugal action increases causing a concentration of contaminants along the inner wall as the reject outlet is approached. The reject portion of the suspension, along with some acceptable fiber, exits the hydrocyclone through the reject outlet at the apex of the conical section of the separation chamber. The acceptable portion of the suspension exits the hydrocyclone axially along the center line of the separation chamber, to an accepts outlet which may be either axial or tangential to the separation chamber.

The high velocity and abrasive nature of the contaminants within the hydrocyclone can cause wear of the separation chamber, most noticeably in the conical section. This wear can, over time, progress to a degree as to form an aperture in the conical section and permit the suspension to leak from the hydrocyclone. In this event, a shutdown of the hydrocyclone and possibly of associated equipment would be necessary in order to replace this component of the separation chamber. This shutdown operation can be very costly. Excessive wear can also create an unsafe condition in which sudden failure of the separation chamber due to weakened wall sections of the chamber could release the pressurized suspension.

The prior art includes hydrocyclones having chambers exterior to the separation chamber into which a leak would flow before reaching the exterior of the hydrocyclone filling the enclosed space. The chambers can eventually become filled with contaminant particles and fibers plugging the leak and making it impossible for operators to detect the leak, rendering the chamber functionless. U.S. Pat. No. 4,278,534 to Jakobson describes a hydrocyclone having the above mentioned outer chamber wherein a leak originating from an aperture in the separation chamber caused by abrasive wear will result in flow to the outer chamber and not to the exterior of the hydrocyclone. U.S. Pat. No. 4,358,369 to Matula et al. describes a hydrocyclone having an outer chamber including an axial "strip" of reduced wall thickness on the wall of the separation chamber, thereby localizing the area in which an aperture will develop. The abrasive particles initially wear through the strip and fluid flows into the outer chamber. This patent describes two solutions: either the outer chamber is constructed from a clear material allowing for the leakage to be detected by sight, or the outer chamber itself contains an aperture from which a leakage will flow into ambient space. The aperture created can be sealed with a screw plug. U.S. Pat. No. 4,211,643 to Frykhult et al. describes a hydrocyclone having an outer chamber surrounding the separation chamber wherein the outer wall includes a plurality of sealable openings. A leakage in the separation chamber will be detected when the fluid is observed flowing from the apertures into ambient space. The leakage can be arrested by using a sealing device.

SUMMARY OF THE INVENTION

In general, the invention features a separation chamber of a hydrocyclone including a conical section, a tangential feed inlet, and an accept outlet, facilitating the detection and repair of a localized leakage. The separation chamber contains reduced wall thickness on at least one portion, and allows the leakage to pass directly from the interior to the exterior of the chamber. The separation chamber does not include an outer chamber to enclose the reduced wall thickness portion. Further, the separation chamber includes a sealing device for sealing the leakage.

In preferred embodiments, the reduced wall thickness is selected to be the area of greatest wear on the separation chamber wall and is constructed from tangential grooves axially or circumferentially spaced apart in the chamber wall, which do not diminish the structural integrity of the chamber. The grooves are adapted to receive pressure resistant sealing devices which maintain geometric similarity to the grooves including predominantly circular devices, predominantly rectangular devices, and threaded devices.

DETAILED DESCRIPTION OF THE INVENTION

Figure 1:
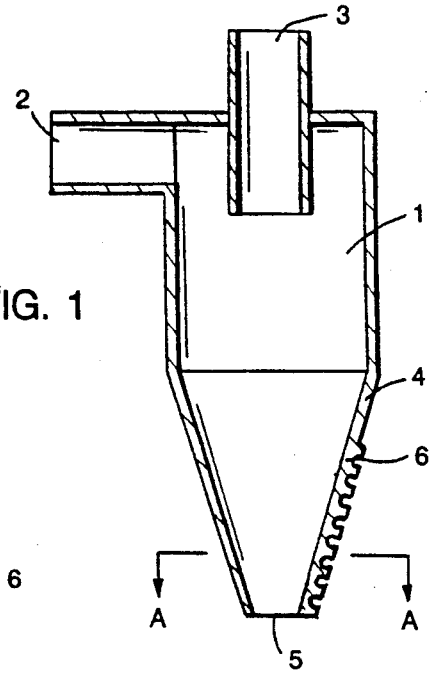
FIG. 1 is an axial sectional view of a hydrocyclone.
Figure 2:
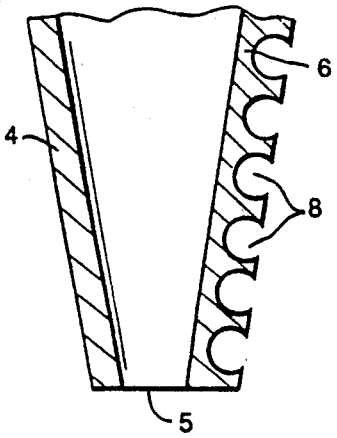
FIG. 2 is a detailed axial sectional view of the conical section of the hydrocyclone.

FIG. 1 is a sectional view of a hydrocyclone used for separating a liquid-solid suspension into an accept portion and a reject portion showing a separation chamber 1, a tangential feed inlet 2, an accept outlet 3, a wall of the conical portion of the separation chamber 4, and a reject outlet 5. FIG. 2 is an enlarged and more detailed sectional view of the conical portion 4 of the separation chamber 1.

It can be seen from FIG. 2 that an opening or aperture resulting from wear at the reduced wall thickness area 6 will permit leakage of the liquid fiber suspension directly to an area outside of the hydrocyclone. There is no enclosed area in which the fiber can build up resulting in a blockage of the aperture. In this invention, leakage will continue until a deliberate plugging of the aperture is performed.

The invention involves no additional components to build the enclosed leakage chamber known in the prior art. A reduced number of components provides for a reduction of leaks or other defects in the hydrocyclone which are the result of its manufacturing.

Figure 3:
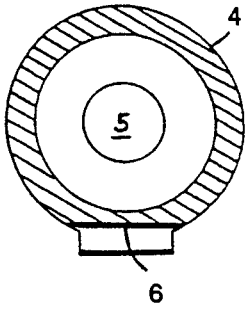
FIG. 3 is a cross-sectional view of the conical section of a hydrocyclone.

FIG. 3 is a sectional view perpendicular to the central axis of the hydrocyclone through one of the reduced wall thickness areas 6. A multitude of the reduced wall thickness areas 6 are located on the separation chamber wall 4.

Figure 4A:
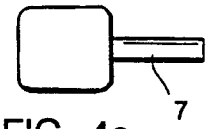
FIG. 4*a* is a side view of a circular sealing device.
Figure 4B:
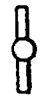
FIG. 4*b* is an end view of a circular sealing device.

In the preferred embodiment of the invention the reduced wall thickness areas 6 are created by tangential grooves 8 (FIG. 2) formed in the separation chamber wall 4. The reduced wall thickness area 6 of the separation chamber constitutes a small portion of the entire separation chamber wall 4 and this does not significantly affect the strength of the chamber 1. As abrasive wear occurs within the separation chamber 1, the interior wall of the chamber will become reduced. The degree of wear will likely vary in the direction axial to the separation chamber 1. However, the degree of wear is consistent circumferentially at a given axial position. The progression of the wear will eventually create an aperture of the chamber wall at a reduced thickness area 6, permitting leakage of the liquid fiber suspension. Leakage will continue until such time that a plug is inserted to block the aperture. FIGS. 4*a* and 4*b* illustrate such a plug 7. The plug is inserted into one of the tangential grooves 8 by sliding the plug 7 in a tangential direction to the outer wall 4 of the chamber. The separation chamber wall 4 and the areas of reduced thickness 6 have features, such as the shape thereof, which retain the plug 7 permitting continued operation without leakage. The presence of a plug 7 at any reduced wall thickness area 6 would indicate that replacement of the separation chamber component as required. The plug 7 may exhibit a color that contrasts with the color of the chamber wall 4 for easy detection of the presence of a plug. Continued operation of the hydrocyclone with a worn separation chamber 1 will result in one or more additional reduced wall thickness areas 6 becoming perforated which will further indicate that replacement of the separation chamber component is needed.

Figure 5A:
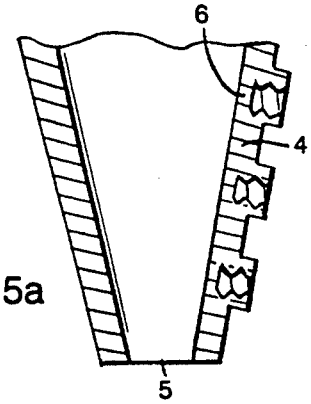
FIG. 5*a* is an axial sectional view of the conical section of a hydrocyclone.
Figure 5B:
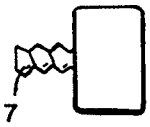
FIG. 5*b* is a side view of a threaded sealing device.
Figure 6A:
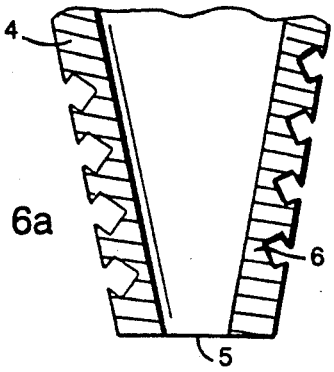
FIG. 6*a* is an axial sectional view of the conical section of a hydrocyclone.
Figure 6B:
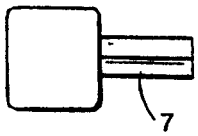
FIG. 6*b* is a side view of a rectangular sealing device.
Figure 6C:
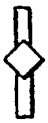
FIG. 6*c* is an end view of a rectangular sealing device.

The scope of the invention is not limited to the embodiment shown in FIG. 2. FIG. 5*a* demonstrates a separation chamber 1 having a plurality of threaded depressions in the chamber wall 4 wherein threaded plugs 7 (as seen in FIG. 5*b*) are used to seal a wear induced aperture. Similarly, FIG. 6*a* demonstrates a separation chamber 1 having a plurality of rectangular grooves 8 with matching plugs 7, as seen in FIGS. 6*b* and 6*c*.

The invention is not confined to the embodiments listed above and one skilled in the art should recognize many modifications to the invention complying with the broadest claims.

What is claimed is:

1. A hydrocyclone for separating abrasive contaminants, said hydrocyclone comprising a generally conical separation chamber having an outer wall subject to wear on its inside surface from said abrasive contaminants, at least one area of reduced wall thickness on said outer wall, said area of reduced wall thickness allowing formation of a localized wear aperture as said abrasive contaminants wear said inside surface, the outside surface of said outer wall being shaped for retaining a sealing member directly against said wear aperture and surrounding said outside surface of said wall to retard flow of liquid through said outer wall following formation of said wear aperture, said area of reduced wall thickness being provided by a substantially tangential groove formed in said outer wall, said groove shaped to restrict the outward movement of said sealing member, and said sealing member having a cross-sectional shape substantially matching that of said groove, so that said sealing member is mated with said groove by sliding in a tangential direction to said outer wall.

2. The hydrocyclone of claim 1 wherein said cross-sectional shape is predominantly circular.

3. The hydrocyclone of claim 1 wherein said cross-sectional shape is predominantly rectangular.

4. The hydrocyclone of claim 1 wherein said sealing member exhibits a color that contrasts with the color of said outer wall for easy detection.

5. The hydrocyclone of claim 1 wherein there are a plurality of said areas of reduced wall thickness and a plurality of said grooves.

6. The hydrocyclone of claim 5 wherein said grooves extend circumferentially.

* * * * *